US005894954A

United States Patent [19]

Horian

[11] Patent Number: 5,894,954

[45] Date of Patent: Apr. 20, 1999

[54] BUSINESS CARD DISPENSER

[75] Inventor: James Horian, Costa Mesa, Calif.

[73] Assignee: Lion Office Products, Inc., Gardena, Calif.

[21] Appl. No.: 08/949,293

[22] Filed: Oct. 13, 1997

[51] Int. Cl.[6] ..... B65H 1/04

[52] U.S. Cl. ..... 221/33; 221/45; 221/37; 206/39.4

[58] Field of Search ..... 221/33, 45, 47, 221/48, 36, 37, 280, 279; 206/39, 39.4, 39.5, 39.6, 39.7, 449, 454, 555, 556; 271/161, 171

[56] References Cited

U.S. PATENT DOCUMENTS

| | | | |
|---|---|---|---|
| 161,225 | 3/1875 | Hall | 209/39 |
| 211,462 | 1/1879 | Dole | 206/39 X |
| 374,509 | 12/1887 | Thum | 206/39 X |
| 825,726 | 7/1906 | Hicks | 206/39.5 |
| 1,003,558 | 9/1911 | Welsh | 206/39 X |
| 1,624,719 | 4/1927 | Dixon | 206/39 |
| 1,631,334 | 6/1927 | Ovarnstrom . | |
| 1,796,262 | 3/1931 | Gaisman | 221/279 |
| 1,955,633 | 4/1934 | Hill . | |
| 2,919,020 | 12/1959 | McCleary | 206/449 |
| 3,679,047 | 7/1972 | Papimyik | 206/39.5 |
| 4,005,794 | 2/1977 | Lundquist | 271/161 |
| 4,444,319 | 4/1984 | Sharber | 206/449 X |
| 4,780,740 | 10/1988 | Fukae | 271/171 X |
| 4,790,435 | 12/1988 | Trusty | 206/39.5 |
| 4,792,058 | 12/1988 | Parker . | |
| 4,915,215 | 4/1990 | Brekke | 206/39 |
| 5,060,794 | 10/1991 | Linn et al. . | |
| 5,172,903 | 12/1992 | Haneda et al. | 271/171 |
| 5,452,793 | 9/1995 | DiMeo, Jr. et al. . | |
| 5,537,195 | 7/1996 | Sagara et al. | 271/171 X |
| 5,730,319 | 3/1998 | Gray et al. | 221/270 X |

*Primary Examiner*—William E. Terrell
*Assistant Examiner*—Patrick Mackey
*Attorney, Agent, or Firm*—Koda & Androlia

[57] ABSTRACT

A business card dispenser comprising a main casing and a sliding tray installed in the main casing in a slidable fashion with a business card(s) placed thereon. The sliding tray is pushed by hand in one direction, thus bending the business card(s) to form an arc so that one business card can be removed, and then the sliding tray is moved back in another (opposite) direction to its original position by an elastic force which is produced by the straightening business card, thus dispensing one card at a time quickly.

4 Claims, 4 Drawing Sheets

BUSINESS CARD DISPENSER

BACKGROUND OF THE INVENTION

1. Field of the Invention

The present invention relates to a card dispenser and more particularly to a portable business card dispensing device.

2. Prior Art

Every businessperson and professional uses business cards so as to identify themselves and their company; and it is truly common for individuals to exchange business cards when they first meet each other. Business cards are significantly important to develop and expand business.

There are various types of containers that store therein business cards. Typically, the business card containers come in two different types: one type being placed on a desk top and another type being carried. A carrying type or portable business card container is widely used today since individuals usually carry a supply of cards whenever businesspeople meet for the purpose of not only business but also private acquaintances.

A typical potable or carrying type conventional container is a wallet type which is made of vinyl or leather. However, since the material of this type of container is soft and easily bent, the business cards can be easily wrinkled. In this regards, a hard-shell type business card container is preferred for businesspeople. The hard-shell type container can be put in the inside pockets of their jackets or in their purses without causing the business cards to winkle. In addition, the hard-shell type business card containers are suitable when they are put in the inner pockets of a briefcase.

There are several different types of hard-shell business card containers as disclosed in the following U.S. Pat. Nos:

1,631,334 1,955,633 4,790,435

4,792,058 5,060,794 5,452,793

However, the business card containers disclosed in these prior art patents have advantages and disadvantages in structure, not exactly meeting the demand of actual use or being suitable for carrying around.

SUMMARY OF THE INVENTION

According, it is a general object of the present invention is to provide a card dispensing device that can store and keep the card-like material, particularly business cards, straight without causing any wrinkling.

It is another object of the present invention to provide a card dispensing device or a business card dispenser that can easily supply a business card one at a time by way of a simple structure.

It is still another object of the present invention to provide a pocket-size business card dispenser that can be carried easily and can dispense one card at a time quickly and without the awkward motion required by traditional vinyl or leather card wallets.

The objects of the present invention is accomplished by a unique structure for a business card dispenser that comprises a main casing and a sliding tray that holds a stack of business cards thereon that is installed in the main casing in a slidable fashion so that when the tray is pushed by a finger of a user in one direction, the middle portions of the business cards on the sliding tray are bent to "pop-up" so as to form an upward arc thus allowing one card to be picked up, and when the finger pushing the sliding tray is removed, the sliding tray is pushed back to its original position by the elastic force of the cards that have been bent and then straighten.

DETAILED DESCRIPTION OF THE INVENTION

Figure 1A:
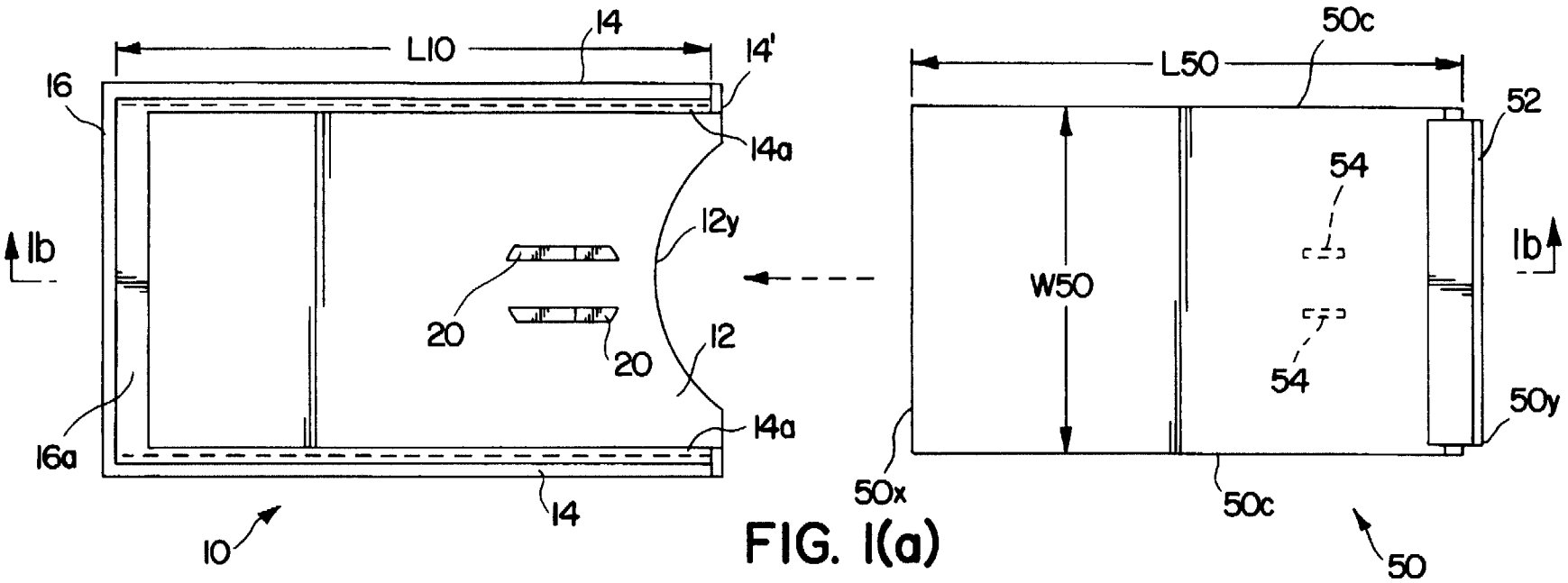
FIG. 1 shows the business card dispenser according to the present invention with the main casing and the sliding tray thereof being separated, and FIG. 1(*a*) is the top view and FIG. 1(*b*) shows the cross section taken along the line 1*b*—1*b;*
Figure 1B:
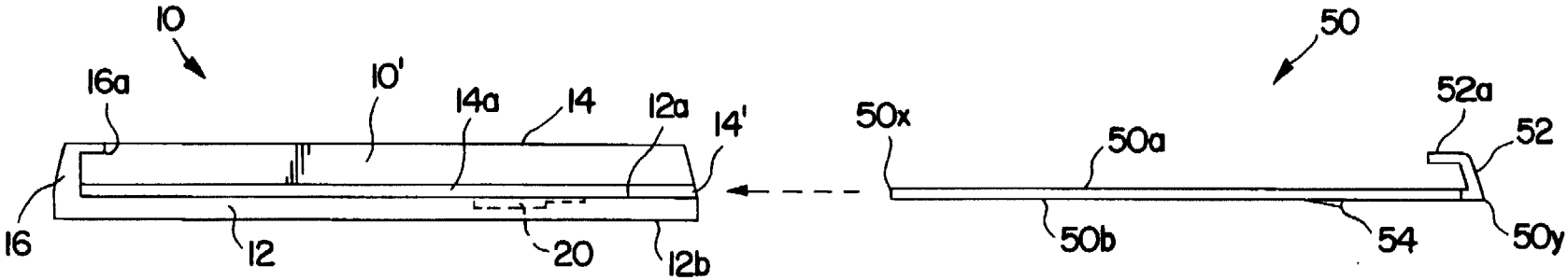

The business card dispenser of the present invention comprises, as shown in FIG. 1, a main casing 10 and a sliding tray 50 that holds business cards therein and is set in the main casing 10 in a slidable fashion.

Figure 2:
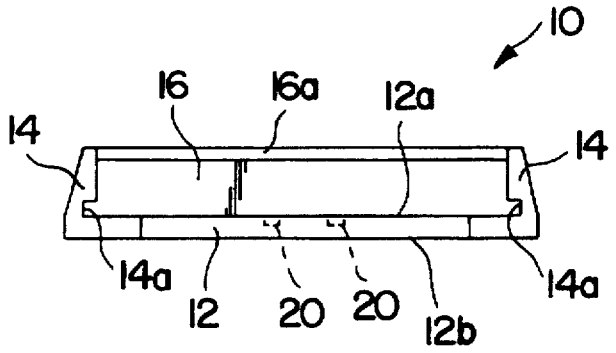
FIG. 2 is a front view of the main casing.

More specifically, the main casing 10 is made of, for instance, a plastic or polypropylene and comprised of a base plate 12, two side walls 14 and an end wall 16. The base plate 12 is in a rectangular shape and has a top surface 12*a* and a bottom surface 12*b*, and side walls 14 and end wall 16 extend upwardly from three edge portions of the base plate 12 at an angle of substantially 90 degrees so as to surround the top surface 12*a* of the base plate 12 and make an interior space 10'. Each of the side walls 14 is provided with a guide grooves 14*a* for the entire length thereof (as indicated by the dotted line in FIG. 1(*a*)) so that the guide grooves 14*a* have a length L10. The guide groove 14*a* is located at the corner formed between the base plate 12 and the side walls 14 as best seen from FIG. 2. The end wall 16 is provided, along its top edge portion, with a flange 16*a* that extends for the entire length thereof and extends inwardly (or toward the side walls 14). In addition, the base plate 12 of the main casing 10 is formed with an inwardly-curved edge 12*y* which is formed on the opposite side from the end wall 16.

The base plate 12 is further provided with two regulation grooves 20 which are formed in the top surface 12*a* thereof so as to be parallel to each other and to the side walls 14. As best seen from FIG. 3 which shows one of two regulation grooves 20, each regulation groove 20 is divided at a ridge 20*a* into two sections in its length-wise direction: a shallow section 20*s*, which is on the inwardly-curved edge 12*y* side (or at a location closer to the inwardly-curved edge 12*y*), and a deep section 20*d*, which is on the end wall 16 side (or at a location closer to the end wall 16). The shallow section 20*s* has a depth D20*s* which is smaller than the depth D20*d* of the deep section 20*d*, and a length L20*d* of the deep section 20*d* is, typically, about 2½ longer than the length L20*s* of the shallow section 20*s*.

The sliding tray 50, on the other hand, is a flat plastic or polypropylene rectangular plate having a top surface 50*a* and a bottom surface 50*b*. The width W50 of the sliding tray 50 is slightly larger than the length of the shorter sides of an ordinary business card (2" by 3.5"), and the length L50 of the sliding tray 50 is slightly shorter than the length of the longer sides of the ordinary business card. As seen from FIG. 1, one end of the sliding tray 50 is defined as a leading end 50*x* and another end thereof as a tail end 50*y*; and an end wall 52 is formed along the tail end 50*y* so as to extend at an acute angle with reference to the top surface 50*a* of the sliding tray 50. The end wall 52 has an inwardly extending flange 52*a* that is formed for the entire length of the end wall 52 and is substantially parallel to the top surface 50*a* of the sliding tray 50.

Both side edges 50*c* of the sliding tray 50 are designed so as to fit in the guide grooves 14*a* of the main casing 10 so that the sliding tray 50, being guided by the guide grooves 14*a*, is slid on the upper surface 12*a* of the base plate 12 of the main casing 10 when pushed by a finger of a user.

Figure 3:
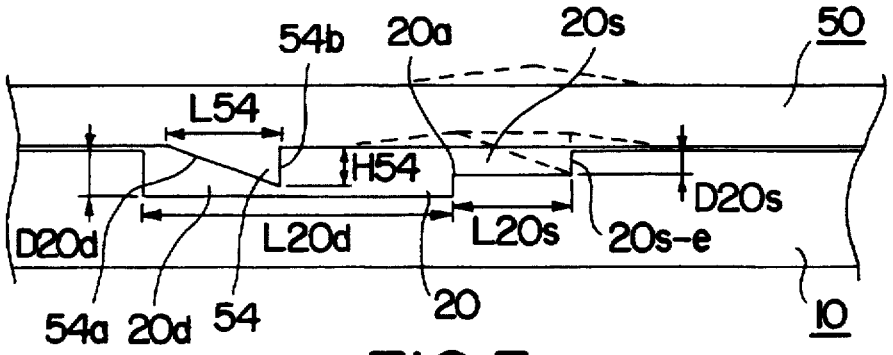
FIG. 3 is an enlarged partial schematic illustration particularly showing the regulation groove formed in the main casing and the stopper projections formed in the sliding tray.

Furthermore, the sliding tray 50 is provided on its bottom surface 50*b* with a pair of parallel stopper projections 54 which have a size so as to be snugly receivable inside the regulation grooves 20 of the base plate 12 of the main casing 10 as shown by the dotted arrows in FIG. 1. The stopper projections 54 extend parallel to the side edges 50*c* of the sliding tray 50; and as shown in FIG. 3 which illustrates one of the pair of stopper projections 54, each one of the projections 54 is formed in a triangular shape, thus having a sliding surface 54*a* and a stopper surface 54*b*. The length L54 of each one of the stopper projections 54 is substantially the same as the length L20*s* of the shallow section 20*s* of the regulation groove 20 of the main casing 10 and is about half the length L20*d* of the deep section 20*d* of the regulation groove 20 so that the stopper projection 54 can be moved inside the deep section 20*d* of the regulation groove 20. The height H54 of the stopper projection 54 is slightly larger than the depth D20*s* of the shallow section 20*d* of the regulation groove 20 and smaller than the depth D20*d* of the deep section 20*d*.

The sliding tray 50 thus structured is set inside the main casing 10 in a slidable fashion with the side edges 50*c* thereof engaged with the guide grooves 14*a* of the main casing 10.

More specifically, both sides of the leading end 50*x* of the sliding tray 50 are fitted at the open ends 14' of the guide grooves 14 of the main casing 10, and then the tray 20 is moved (or pushed) by a finger of a user towards the end wall 12 of the main casing 10.

The stopper projections 54 formed on the bottom surface 50*b* of the sliding tray 50 are slid over the upper surface 12*a* of the bottom plate 12 of the main casing 10 and enter into the shallow sections 20*s* and then further into the deep section 20*d* of the regulation grooves 20 of the main casing 10. This position of the sliding tay 50 is called a first position and is shown in FIG. 5(*a*).

Since the length L54 of the stopper projections 54 is smaller (or shorter) than the length L20*d* of the deep section 20*d* of the main casing 10, the sliding tray 50 can be easily moved (pushed) further forward towards the end wall 16 of the main casing 10 until the leading end 50*x* of the sliding tray 50 comes into contact with the end wall 16 of the main casing 10. This position of the tray 50 (where the leading end 50*x* is in contact with the end wall 16) is called a second position and shown in FIG. 5(*b*). Because of the inwardly-curved edge 12*y* formed in the base plate 12 of the main casing 10, the pushing of the sliding tray 50 as described above is not hindered.

Figure 4:
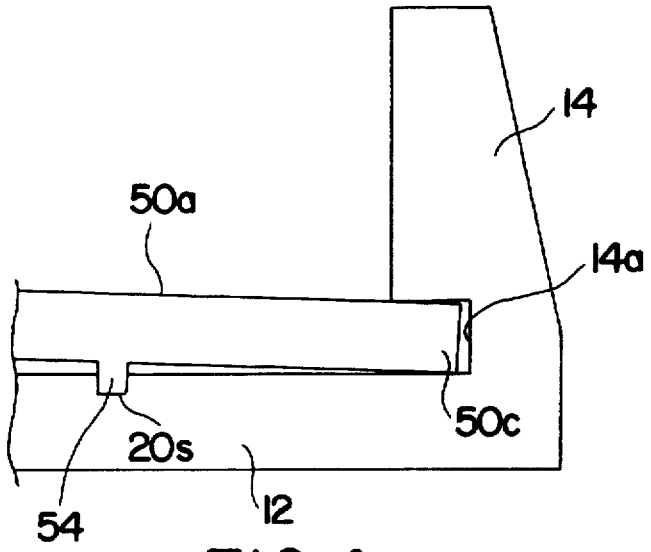
FIG. 4 is an enlarged partial schematic illustration particularly showing the sliding tray engaged with the guide groove of the main casing.

Conversely, when the sliding tray 50 is moved (or pulled) by hand from the first position in the direction opposite from the end wall 16 of the main casing 10, the stopper projections 54 are slid over the ridge 20*c* (see FIG. 3) and moved into the shallow section 20*s* from the deep section 20*d* until the stopper surface 54*b* comes into contact with the end wall 20*s–e* of the shallow section 20*s*. This position of the sliding tray 50 is called a third position and is shown in FIG. 5(*c*). In this third position, since the height H54 of the stopper projections 54 are larger (higher) than the depth D20*s* of the shallow section 20*s* of the regulation groove, the sliding tray 50 is slightly raised or lifted as shown by the dotted lines in FIG. 3. As a result, as shown in FIG. 4, the upper surfaces of both side edges 50*c* (only one shown) of the sliding tray 50 are pressed against the upper inner surfaces of the guide grooves 14*c*, and the lower surfaces of both side edges 50*c* of the sliding tray 50 are pressed against the lower inner surfaces of the guide grooves 14*c*, thus making an elastic engagement between them; and any movement of the sliding tray 50 is restrained. Thus, the sliding tray 50 stays in this third position unless a further force is applied to the sliding tray 50 by the user. If the sliding tray 50 is moved by hand more strongly in the direction opposite from the rear wall 16 of the main casing 10, then the stopper projections 54 can be moved out of the shallow section 20*d* of the regulation groove 20 and slid over the upper surface 12*a* of the base plate 12 of the main casing 10, thus being removed from the main casing 10.

Figure 5A:
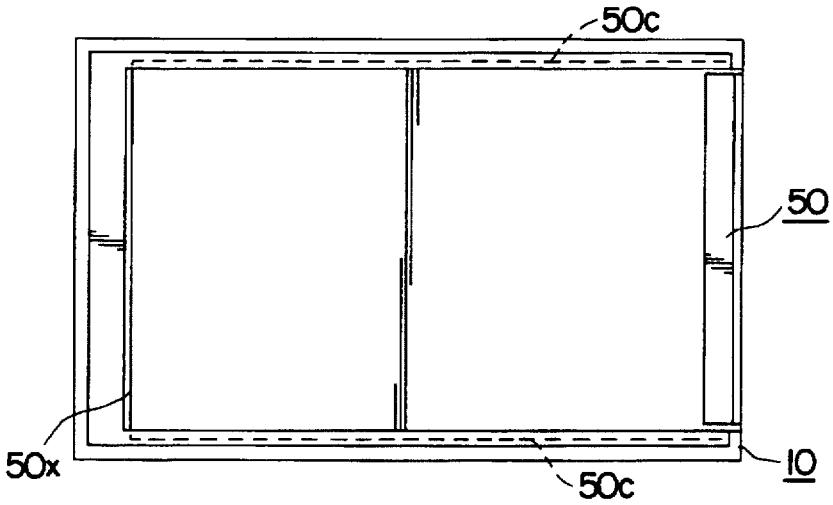
FIGS. 5(*a*), 5(*b*) and 5(*c*) respectively show the first position, second position and third position of the sliding tray relative to the main casing.
Figure 5B:
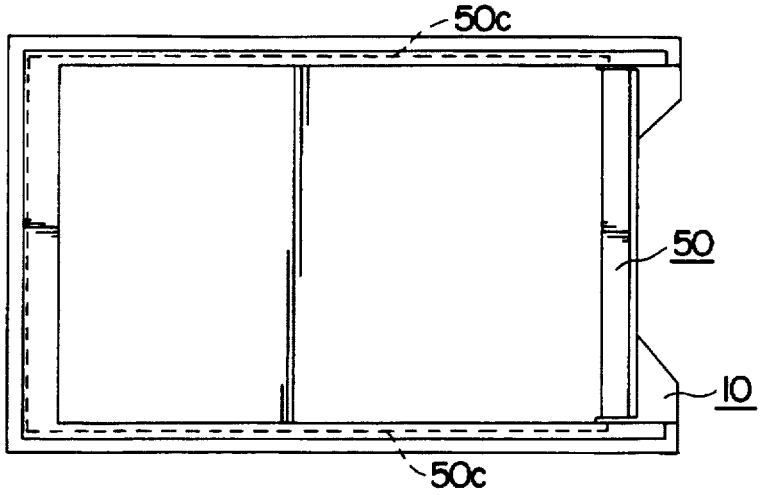
Figure 5C:
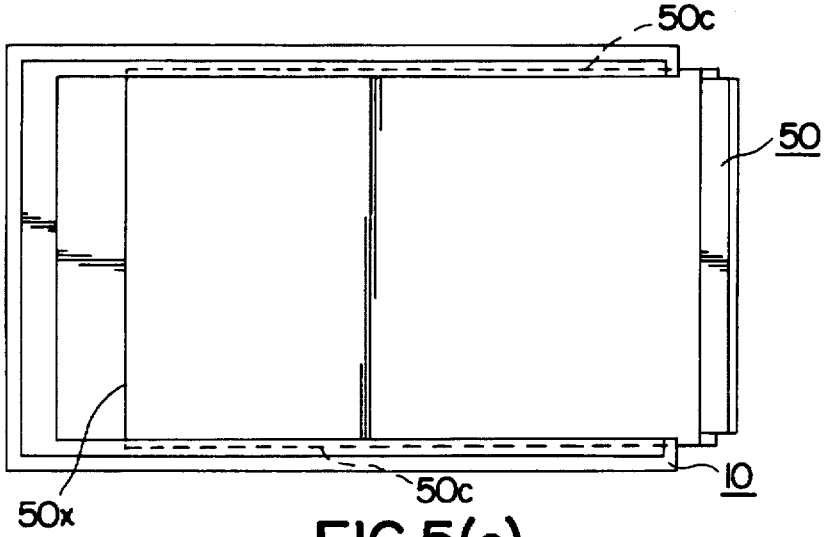

The length L10 of the main casing 10, the length L50 of the sliding tray 50 and the locations of the regulation grooves 20 and stopper projections 54 are selected so that the inside space defined by the main casing 10 and the sliding tray 50 at the first position (FIG. 5(*a*)) is substantially the same as the size of a common business card, the inside area defined by the main casing 10 and the sliding tray 50 at the second position (FIG. 5(*b*)) is smaller than the size of the business card, and the inside area defined by the main casing 10 and the sliding tray 50 at the third position (FIG. 5(*c*)) is larger than the size of the business card.

Accordingly, with the structure described above, the sliding tray 50, in use, is first positioned at the third position. At this third position which is shown also in FIG. 6(*c*), since the sliding tray 50 is restrained so as not to move because of the stopper projections 54 and side edges 50*c* thereof that are elastically engaged (due to its material) respectively with the shallow sections 20*s* of the regulation grooves 20 and the guide grooves 14*a* of the main casing 10, a stack of business cards or about 15 standard business cards B can be placed on (the upper surface 50*a* of) the sliding tray 50 as shown by the dotted arrow in FIG. 6(*c*).

Then, the sliding tray 50 is pushed by a finger, overcoming the elastic engagement between the stopper projections 54 and the shallow sections 20*s* of the regulation grooves 20, so that the sliding tray 50 is moved to the first position. At this first point which is shown also in FIG. 6(*a*), the stopper projections 54 are inside the deep sections 20*d* of the regulation grooves 20; and since as shown in FIG. 3, the length L54 of the stopper projections 54 is smaller than the length L20*d* of the deep sections 20*d*, the sliding tray 50 has a play (free movement) within the length L20*d* of the deep section 20*d* of the regulation grooves 20; however, the backward movement which is in the direction opposite from the end wall 16 of the main casing 10 is restricted by the stopper surface 54*b* coming into contact with the ridge 20*c* of the deep section 20*d* of the regulation grooves 20, and the forward movement which is toward the end wall 16 of the main casing 10 is restricted by the edges of the stack of business cards B coming into contact with the end wall 16. Accordingly, the sliding tray 50 stays in the main casing 10, and the business cards B are prevented from falling out of the sliding tray 50 since both edge portions of the cards are caught by the flange 16*a* of the end wall 16 of the main casing 10 and by the flange 52*a* of the end wall 52 of the sliding tray 50. Thus, the card dispenser comprising the sliding tray 50 engaged with the main casing 10 can be carried anywhere without allowing the business cards to fall out.

When the business cards are to be taken out of the card dispenser, the dispenser is held by one hand of a user by placing the thumb, for instance, on the end wall 52 of the sliding tray 50 and the middle finger on the end wall 16 of the main casing 10, or the other way around.

Figure 6A:
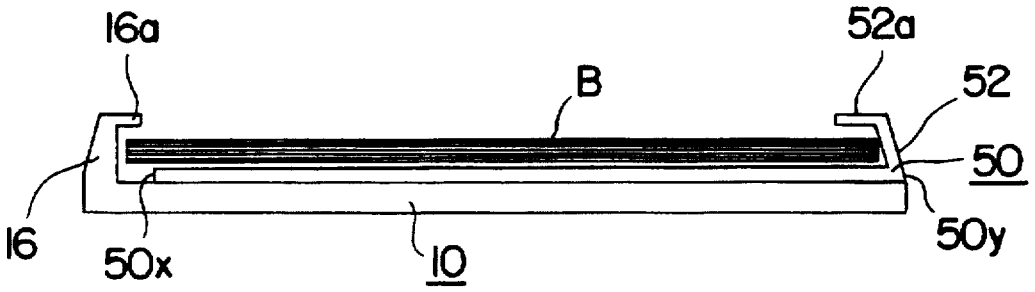
FIGS. 6(*a*), 6(*b*) and 6(*c*) respectively show three different positions of the sliding tray with a stack of business cards thereon.
Figure 6B:
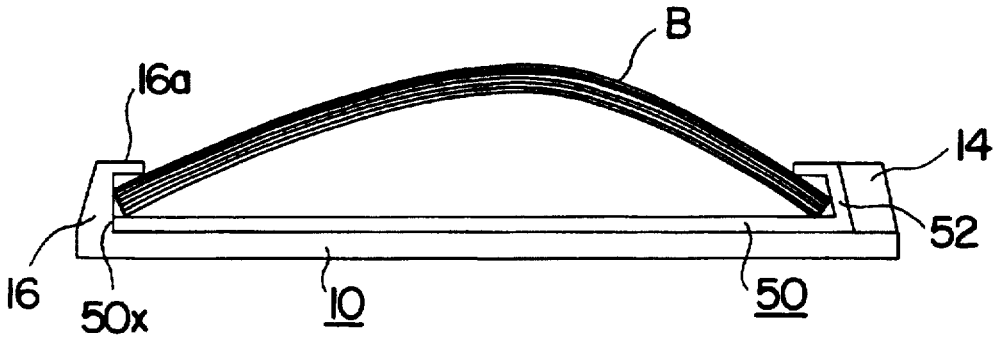
Figure 6C:
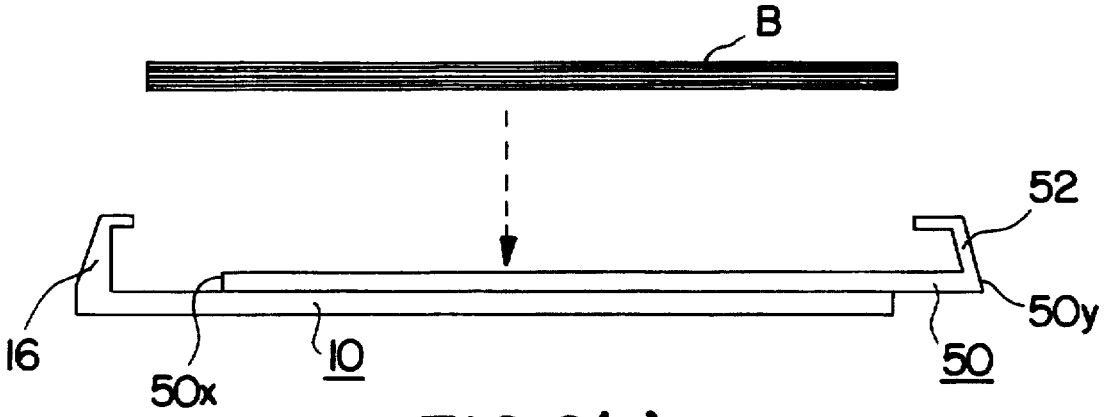

Then, the sliding tray 50 is pushed by the thumb to the second position, which is shown also in FIG. 6(*b*). In other words, by squeezing the end wall 16 of the main casing 10 and the end wall 52 of the sliding tray 50 together, the sliding tray 50 is moved toward the end wall 16 of the main casing 10 until the front edge 50*x* of the sliding tray 50 comes into contact with the end wall 16. Since both ends of the business cards are in contact with the end wall 16 of the main casing 10 and the end wall 52 of the sliding tray 54, the pushing force by the thumb bend the stack of the business cards B upward so that they make a convex arc as shown in FIG. 6(*b*); and by holding the sliding tray 50 at this position, the upper most business card of the arced stack of business cards B can be removed or picked up by another hand (or by a person receiving the card). After a single card is removed from the stack, the thumb holding the sliding tray 50 is removed; and when the thumb is removed or the squeezing force is thus released, the bent or arc-shaped stack of business cards B straighten or extend by their own elasticity so as to regain their original, flat shape, thus pushing back the sliding tray 50 to the first position shown in FIG. 6(*a*). A dispense of one business card is thus finished.

By repeating the above squeezing and releasing motions or, in particular, by pushing the sliding tray 50 from the first position to the second position and then letting the business cards push back the sliding tray 50 from the second position to the first position, it is possible to dispense one card at a time quickly and smoothly without the awkward motion required by existing traditional vinyl card wallets.

When all the business cards are dispensed, the sliding tray 50 is moved from the first position to the third position by hand by bringing the stopper projections 54 to move over the ridge 20*c* into the shallow section 20*d* so that another stack of business cards are placed in the card dispenser. If the sliding tray 50 is further moved by hand from the third position towards the direction opposite to the end wall 16 of the main casing 10, the sliding tray 50 can be removed from the main casing 10. A supply of business cards can be placed on the thus removed sliding tray 50 and then inserted back into the main casing 10 as described above.

In the above embodiment, the sliding tray 50 has two (2) sliding projections which are arranged parallel to each other; however, the sliding tray 50 can have only one sliding projection. In addition, the two (2) sliding projections can be arranged linearly (not parallel as in the described embodiment), or more than two (2) sliding projections can be arranged in a zig-zag or in any desired pattern along with the regulation grooves 20 of the main casing 10 that are formed so as to correspond thereto.

In addition, the embodiment above is described with reference to a stack of business cards; however, the structure of the present invention can work to allow a single card to be dispensed.

Furthermore, the flange 16*a* of the main casing 10 and the flange 52*a* of the sliding tray 50 are formed so as to extend for the entire width of the main casing 10 and sliding tray 50, respectively, in the embodiment above; however, it is obvious that each of them may have cut-out portions as seen from FIG. 8 as far as the card(s) inside does not fall when the dispenser is up-side-down.

Though the invention has been described with respect to a preferred embodiment, many variations and modifications will now become apparent to those skilled in the art; and it should be noted that the present invention may be embodied in other specific forms without departing from the spirit or essential attributes thereof.

I claim:

1. A device for holding business cards comprising:

a main casing having a base plate with a pair of parallel side walls and an end wall so as to define three walls of an interior space, said pair of parallel side walls and said end wall having lengths substantially equal to the length and width of a business card respectively, a sliding tray installed slidably within said interior space of said main casing and having an end wall, said sliding tray being movable in one direction by hand so said end wall of said sliding tray engages and bends said business card placed on said sliding tray and then moved back in an opposite direction by an elastic force produced by said business card straightening.

2. A holder for business cards comprising:

a main casing having a base plate which is provided with a pair of parallel side walls and an end wall upwardly extending from edge portions of said base plate, said pair of side walls and said end wall having lengths substantially equal to a length and width of a business card respectively, each of said side walls having guide grooves that extend in a direction of the length of said walls;

an elongated regulation groove that has a predetermined length and is parallel to said side walls provided on said base plate;

a sliding tray having an end wall at one end thereof and slidably installed on said base plate of said main casing with both side edges thereof being engaged with said guide grooves, said sliding tray having a top surface on which said business card is placed and a bottom surface which slides on an upper surface of said base plate of said main casing; and an engagement projection provided on a bottom surface of said sliding tray and engaged with said regulation groove of said main casing so that said sliding tray is moved in one direction by hand so as to bend said business card and then moved back in an opposite direction by an elastic force produced by said business card straightening.

3. The holder according to claim 2, wherein both said end wall on said main casing and sliding tray are provided with inwardly projecting lips.

4. The holder according to claim 3, wherein said engagement projection is triangular in shape.

* * * * *